United States Patent [19]

Hikino et al.

[11] Patent Number: 4,616,993

[45] Date of Patent: Oct. 14, 1986

[54] LIQUID FUEL COMBUSTION APPARATUS

[75] Inventors: Tadashi Hikino, Ikoma; Kunihiro Turuda, Kashihara, both of Japan

[73] Assignee: Matsushita Electric Industrial Co., Ltd., Japan

[21] Appl. No.: 627,726

[22] Filed: Jul. 3, 1984

[30] Foreign Application Priority Data

| | | | |
|---|---|---|---|
| Jul. 7, 1983 | [JP] | Japan | 58-123828 |
| Jul. 7, 1983 | [JP] | Japan | 58-123829 |
| Jul. 26, 1983 | [JP] | Japan | 58-136992 |

[51] Int. Cl.[4] ..... F23N 1/00; F23D 11/44

[52] U.S. Cl. ..... 431/41; 431/208; 431/331

[58] Field of Search ..... 431/36, 41, 208, 218, 431/260, 331, 11; 126/19 R, 59.5

[56] References Cited

U.S. PATENT DOCUMENTS

| | | | |
|---|---|---|---|
| 3,962,561 | 6/1976 | Maitenaz | 126/19 R X |
| 4,374,754 | 2/1983 | Arai | 126/19 R X |

FOREIGN PATENT DOCUMENTS

| | | | |
|---|---|---|---|
| 0001540 | 1/1977 | Japan | 431/333 |
| 52-30925 | 3/1977 | Japan . | |
| 0053610 | 4/1980 | Japan | 431/208 |
| 55-63307 | 5/1980 | Japan . | |
| 58-168805 | 10/1983 | Japan . | |

*Primary Examiner*—Margaret A. Focarino

*Attorney, Agent, or Firm*—Wenderoth, Lind & Ponack

[57] ABSTRACT

In a circular vaporizing type liquid fuel combustion apparatus for reducing the quantity of tar accumulation therein, the inner wall of the metal vessel is coated with a film which consists essentially of 15.0 to 50.0 wt. % high-thermal conductive and high-emissive material, a catalyst for decomposing organic materials and a binder, the temperature of the metal vessel being kept in the film boiling temperature region.

18 Claims, 10 Drawing Figures

FIG. 1(a)
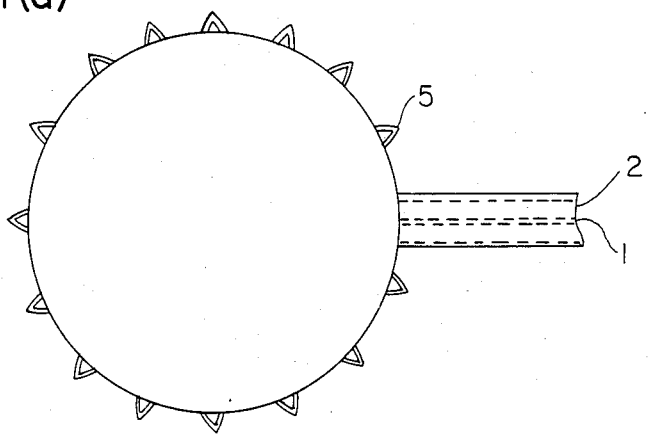
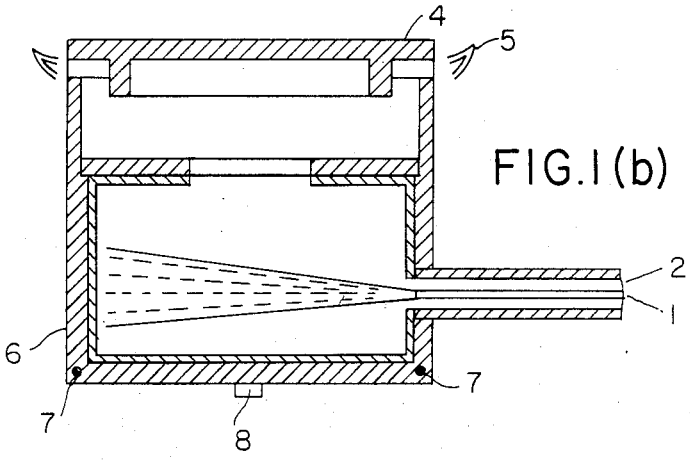
FIG. 1(b)

FIG. 4(a)
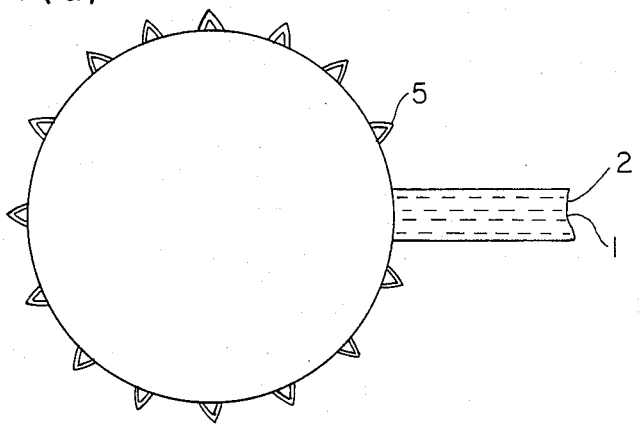
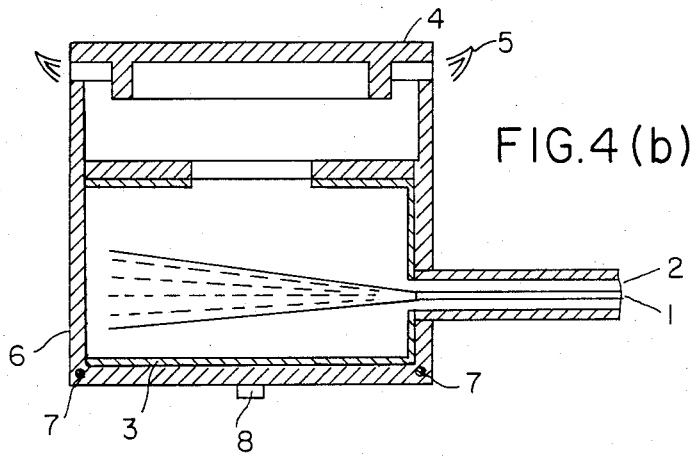
FIG. 4(b)

FIG. 6 (a)
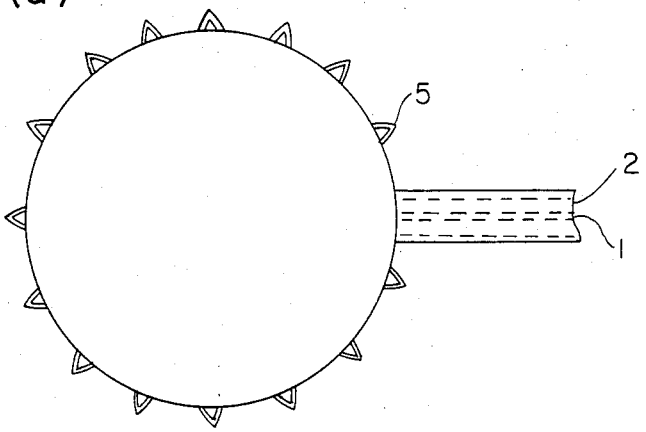
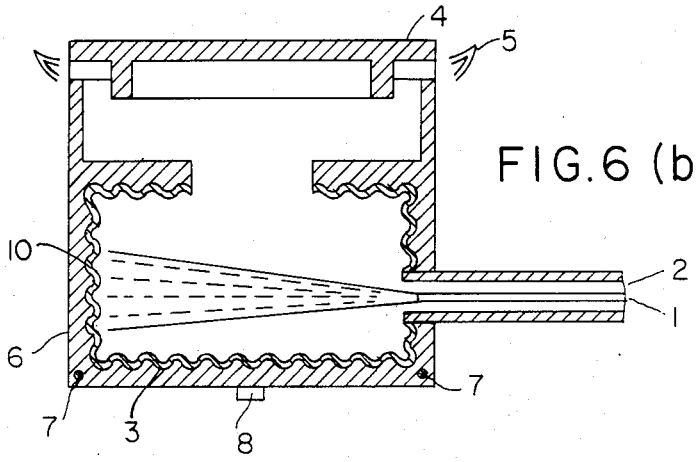
FIG. 6 (b)

LIQUID FUEL COMBUSTION APPARATUS

BACKGROUND OF THE INVENTION (1) Field of the Invention

The present invention relates to a vaporizing type liquid fuel combustion apparatus which is used for heating and more particularly to the vaporizer in which the liquid fuel vaporizes.

(2) Prior Art

Conventionally, a vaporizer of the fuel combustion apparatus is made of metal such as aluminium, iron or stainless steel or is made of metal of which inner wall is coated with a heat-insulating film.

The temperature of the vaporizer is usually kept in a nucleation boiling temperature region.

Accordingly, tar is accumulated in the inner wall of the vaporizer. The accumulation of tar causes injurious phenomena at the beginning or the end of combustion, for example, the exhaustion of offensive smell, or the retardation of combustion.

SUMMARY OF THE INVENTION

An object of the present invention is to provide a vaporizer of a vaporizing type liquid fuel combustion apparatus which accumulates tar in small quantities compared with the conventional apparatus.

Another object of the invention is to provide a vaporizer of a vaporizing type liquid fuel combustion apparatus which is a circular metal vessel coated with a film consisting essentially of a high-thermal conductive and high-emissive material, a catalyst for decomposing organic materials and a binder.

The temperature of the circular metal vessel coated with a film is continually detected by a thermometer attached to the circular metal vessel to keep the liquid fuel film at a boiling temperature region by heating with both an electric sheath heater embedded in the circular metal vessel and combustion heat feedback by thermal conduction from a burner head disposed on the metal vessel.

BRIEF DESCRIPTION OF THE DRAWINGS

FIG. 1(*a*) is a top schematic sectional view of an embodiment of the invention; and FIG. 1(*b*) is a side sectional view of the embodiment shown in FIG. 1(*a*);

FIG. 4(*a*) is a top schematic sectional view of another embodiment of the invention;

FIG. 4(*b*) is a side sectional view of the embodiment shown in FIG. 4(*a*)

FIG. 6(*a*) is a top schematic sectional view of another embodiment of the invention;

FIG. 6(*b*) is a side sectional view of the embodiment shown in FIG. 6(*a*)

DETAILED DESCRIPTION OF THE PREFERRED EMBODIMENTS

Figure 2:
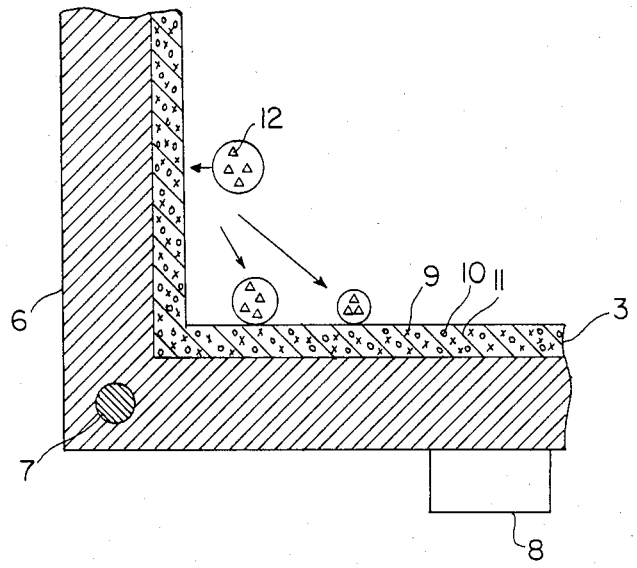
FIG. 2 is an enlarged schematic sectional view of a vaporizer.

Referring now to the drawings, FIG. 1 shows a schematic sectional view of a heating apparatus used in a home room which is equipped with one embodiment of the vaporizing type liquid fuel combustion apparatus of the invention.

In FIG. 1, the liquid fuel vaporizer comprising a liquid fuel inlet 1, an air inlet 2, and inner wall 3 coated with a film.

A mixed gas composed of fuel and air burns at the burner head 4 disposed on the metal vessel 6 and forms the flame 5.

An electric sheath heater 7, shown in FIG. 1(*b*), for vaporizing liquid fuel is embedded in the metal vessel 6.

A thermometer 8 is to detect the temperature of the vaporizer.

FIG. 2 shows an enlarged schematic sectional view of the vaporizer of the invention.

In FIG. 2, a film for reducing tar consists of a high-thermal conductive and high-emissive material 9 (shown as x), a catalyst 10 for decomposing organic materials (shown as o), and a binder 11 (shown as an oblique line).

The vaporizing type liquid fuel combustion apparatus equipped with the above-mentioned vaporizer, with the film at a liquid fuel boiling temperature region accumulates tar in small quantities compared with the conventional apparatus, when an impure liquid fuel containing non-volatile composition 12 (shown as Δ) being changed to tar is vaporized.

The high-thermal conductive and high-emissive material of the film is selected from the group of carbon, graphite, beryllium oxide, magnesium oxide, silicon-carbide, vanadium-carbide, tungsten-carbide, titanium-carbide, boron-nitride, and zirconium-boride.

The catalyst for decomposing organic materials is selected from the group of the oxide of titanium, zirconium, vanadium, chromium, molybdenum, tungsten, manganese, iron, cobalt, nickel, copper, and rare earth metal, the element of platinum and palladium, the inorganic compound of acidic clay, zeolite, calcium silicate, alumina-cement and potassium carbonate.

The binder is selected from the group of water soluble phosphate, water soluble silicate and silicone resin.

The film consists essentially of 15.0~50.0 wt.% high-thermal conductive and high-emissive material, 0.1~15.0 wt.% catalyst for decomposing organic materials and 40.0~80.0 wt.% binder.

The high-thermal conductive and high-emissive material in the film contributes to reduce the accumulation of tar because it accelerates the vaporization of volatile components of the liquid fuel for the sake of thermal action. If a high-thermal conductive and low-emissive material such as aluminium is added to the film instead of the high-thermal conductive and high-emissive material and the temperature of the vaporizer is kept in the film boiling region, the vaporizing time for a drop of liquid fuel increases due to recombination of the drops.

The increase in vaporizing time causes an unstable combustion such as rising of yellow flame.

The catalyst for decomposing organic material contributes to decrease tar, decomposing non-volatile components of the liquid fuel by oxidation, partial oxidation or cracking.

The binder is indispensable for binding the high-thermal conductive, high-emissive material and the catalyst to the vaporizer.

A hardening agent is added to the binder to assure complete hardening of the film and to reduce the time of hardening.

A filler is added to the binder to assure fire-resistance, oil-resistance and water-resistance.

The inner structure of the vaporizer also effects the accumulation of tar, for example, the roughness of the inner wall, and the elimination of the film in part.

Hereinafter, describing in detail by examples, (1) An apparatus equipped with the conventional vaporizer of which inner wall is coated with a low-thermal conductive film which is composed of ferrite as filler and silicone resin as binder.

The schematic sectional view of the apparatus is the same as in FIG. 1.

The vaporizer is made of aluminized iron of 1.6 mm thickness, of which the inner diameter is 40 mm and of which height is 30 mm.

The thickness of the coated film is 30 μm, the emissivity is 0.80, and the thermal conductivity is 0.8 kcal/m.hr.°C. at 200° C.

Figure 3:
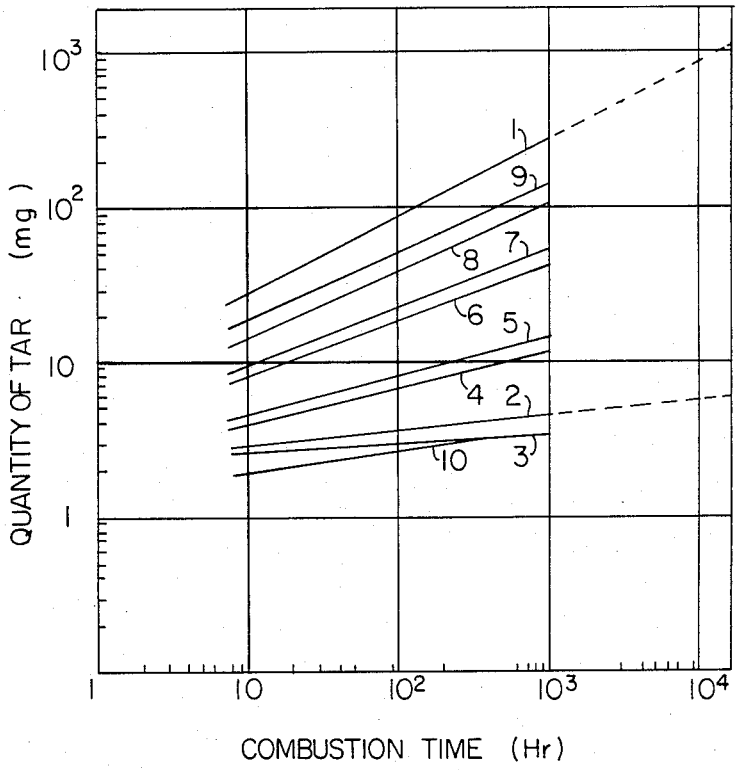
FIG. 3 is a graph showing the relation between the quantity of tar accumulated versus the combustion time.

The above described apparatus accumulates tar as shown and characterized by curve 1 in FIG. 3.

The test conditions are as follows;

the temperature is kept at 350° C. by heating with the electric sheath heater and feedback of combustion heat from the burner, the liquid fuel is supplied at the rate of 2.8 lit./Hr, and the liquid fuel is an impure kerosene which contains 37.5 ppm of non-volatile components, and the air is supplied at the rate of 5.3 $Nm^3/Hr$.

The characteristic curve 1 shows that the quantity of accumulated tar at 1000 hours is about 300 miligrams and the quantity at 15000 hours is estimated at over 1 gram.

It is confirmed that the apparatus equipped with a vaporizer in which 1 gram of tar accumulated exhausts offensive smell, hydrocarbon and carbon monoxide at the beginning or the end of combustion.

In the above described vaporizer, the liquid fuel does not vaporize as a boiling liquid fuel film due to the low thermal conductivity of the coated film, and the tar accumulates at the bottom of the vaporizer.

Some embodiments of the present invention are described in detail by examples as follow.

(2) Preparing the apparatus according to the present invention wherein the shape and dimensions of the vaporizer are the same as in example 1, the inner wall of the vaporizer is coated with a film which consists essentially of 45.0 wt.% graphite as the high thermal conductive and high emissive material, 10.0 wt.% manganese dioxide as the catalyst for decomposing organic materials and 45.0 wt.% binder.

The binder is composed of aluminium phosphate as the major agent, sodium phosphate as a hardening agent and alumina as a filter.

The thickness of the coated film is 30 μm, the emissivity is 0.9, and the thermal conductivity is 15 kcal/m.hr.°C. at 200° C.

The present apparatus accumulates tar under the same test conditions as in example (1) as shown and characterized by curve 2 in FIG. 3.

The characteristic curve 2 shows that the quantity of accumulated tar at 1000 hours is about 4.3 milligrams and the quantity at 15000 hours is estimated at only 6 milligrams.

Figure 5:
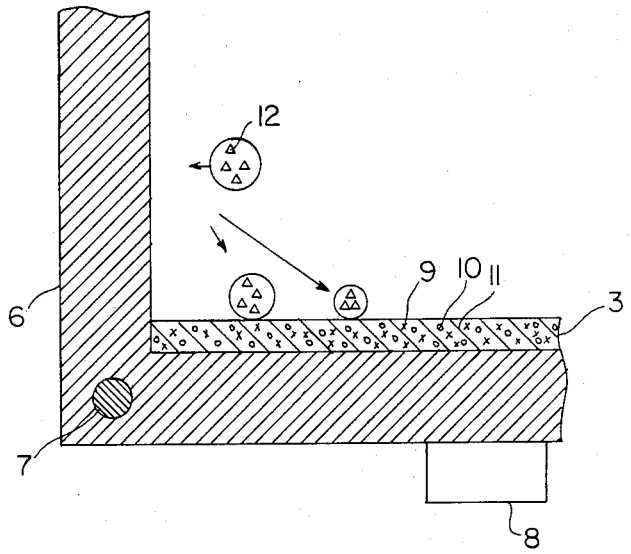
FIG. 5 is an enlarged schematic sectional view of said embodiment.

(3) FIG. 4 and FIG. 5 show the schematic sectional view and the enlarged view of another vaporizer according to the present invention. The inner wall of the vaporizer is coated with the same film as in example (2) except for the wall where the liquid fuel impinges against.

The present apparatus accumulates tar under the same test conditions as in example (1) as shown and characterized by curve 3 in FIG. 3.

The characteristic curve 3 shows that the quantity of accumulated tar at 1000 hours is about 3.2 milligrams.

(4) Preparing the another apparatus, shown in FIG. 4(*b*), according to the present invention wherein the shape and dimensions of the vaporizer are the same as in example 1, the inner wall of the vaporizer is coated with a film which is composed of 20.0 wt.% beryllium oxide as high thermal conductive and high-emissive material, 10.0 wt.% alumina cement as catalyst for decomposing organic materials and 70.0 wt.% binder.

The binder is composed of sodium silicate as major agent and silica as filler.

The thickness of the coated film is 30 μm, the emissivity is 0.82, and the thermal conductivity is 10 kcal/m.hr.°C. at 200° C.

The present apparatus accumulates tar under the same test conditions as in example (1) as shown and characterized by curve 4 is FIG. 3.

The characteristic curve 4 shows that the quantity of accumulated tar at 1000 hours is about 12 milligrams.

(5) Preparing the another apparatus, shown in FIG. 4(*b*), according to the present invention wherein the shape and dimensions of the vaporizer are the same as in example 1, the inner wall of the vaporizer is coated with a film which is composed of 23.0 wt.% graphite as high-thermal conductive and high-emissive material, 76.8 wt.% binder and 0.2 wt.% platinum as catalyst for decomposing organic materials carried on the film.

The binder is composed of aluminum phosphate as major agent, sodium phosphate as hardening agent and alumina as filler.

The thickness of the film is 30 μm, the emissivity is 0.81 and the thermal conductivity is 7 kcal/m.hr.°C. at 200° C.

The present apparatus accumulates tar under the same test conditions as in example (1) as shown and characterized by curve 5 in FIG. 3.

The characteristic curve 5 shows that the quantity of accumulated tar at 1000 hours is about 13 milligrams.

(6) Preparing the another apparatus, shown in FIG. 4(*b*), according to the present invention wherein the shape and dimensions of the vaporizer are the same as example 1, the inner wall of the vaporizer is coated with a film which is composed of 23.0 wt.% graphite as high-thermal conductive and high-emissive material, 10.0 wt.% manganese dioxide as catalyst for decomposing organic materials, and 67.0 wt.% binder. The binder is composed of aluminum phosphate as major agent, sodium phosphate as hardening agent and alumina as filler.

The thickness of the film is 30 μm, the emissivity is 0.83 and the thermal conductivity is 8 kcal/m.hr.°C. at 200° C.

The present apparatus accumulates tar under the same test conditions as in example (1) as shown and characterized by curve 6 in FIG. 3. The characteristic curve 6 shows that the quantity of accumulated tar at 1000 hours is about 40 milligrams.

(7) Preparing the another apparatus, shown in FIG. 4(*b*), according to the present invention wherein the shape and dimensions of the vaporizer are the same as in example 1, the inner wall of the vaporizer is coated with a film which is composed of 23.0 wt.% graphite as high thermal conductive and high-emissive material, 8.0 wt.% zeolite [$Ca(Na, K)_4Al_6Si_{30}O_{72}$], 2.0 wt.% acidic clay [$Al_2Si_{13}O_{29}$] as catalyst for decomposing organic material and 67.0 wt.% binder.

The binder is composed of aluminum phosphate as major agent, sodium phosphate as hardening agent and alumina as filler. The thickness of the film is 30 μm, the emissivity is 0.83 and thermal conductivity is 6 kcal/m.hr.°C. at 200° C.

The present apparatus accumulates tar under the same test conditions as in example (1) as shown and characterized by curve 7 in FIG. 3. The characteristic curve 7 shows that the quantity of accumulated tar at 1000 hours is about 52 milligrams.

(8) Preparing the another apparatus, shown in FIG. 4(*b*), according to the present invention wherein the shape and dimensions of the vaporizer are the same as in example 1, the inner wall of the vaporizer is coated with a film which is composed of 20.0 wt.% zirconium boride as high thermal conductive and high emissive material, 13.0 wt.% manganese dioxide as catalyst for decomposing organic materials and 67.0 wt.% binder. The binder is composed of silicone resin as major agent and ferrite as filler.

The thickness of the film is 30 μm, the emissivity is 0.81 and thermal conductivity is 6 kcal/m.hr.°C. at 200° C.

The present apparatus accumulates tar under the same test conditions as in example (1) as shown and characterized by curve 8 in FIG. 3. The characteristic curve 8 shows that the quantity of accumulated tar at 1000 hours is about 110 milligrams.

(9) Preparing the another apparatus, shown in FIG. 4(*b*), according to the present invention wherein the shape and dimensions of the vaporizer are the same as in example 1, the inner wall of the vaporizer is coated with a film which is composed of 20.0 wt.% silicon carbide as high thermal conductive and high-emissive material, 10.0 wt.% calcium silicate as catalyst for decomposing organic materials and 70.0 wt.% binder.

The binder is composed of sodium silicate as major agent and silica as filler.

The thickness of the film is 30 μm, the emissivity is 0.80 and thermal conductivity is 4 kcal/m.hr.°C. at 200° C.

The present apparatus accumulates tar under the same test conditions as in example (1) as shown and characterized by curve 9 in FIG. 3. The characteristic curve 9 shows that the quantity of accumulated tar at 1000 hours is about 140 milligrams.

(10) Preparing still another apparatus, as shown in FIG. 6(*b*), according to the present invention, the vaporizer is made of aluminium of 3 mm thickness, of which inner diameter is 40 mm and of which height is 30 mm.

The inner wall of the vaporizer is roughened in the average roughness of 700 μm, and is coated with a film which is composed of 45.0 wt.% graphite as high thermal conductive and high emissive material, 10.0 wt.% manganese dioxide as catalyst for decomposing organic materials and 45.0 wt.% binder.

The binder is composed of aluminium phosphate as major agent, sodium phosphate as hardening agent and alumina as filler.

The thickness of the coated film is 30 μm, the emissivity is 0.9, and the thermal conductivity is 15 kcal/m.hr.°C. at 200° C.

Figure 7:
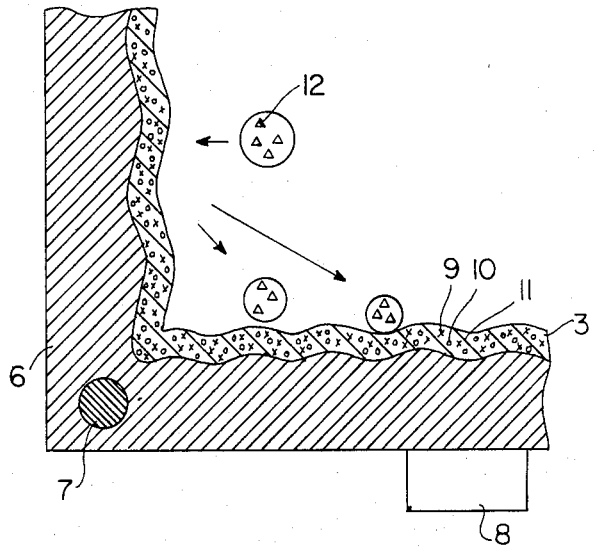
FIG. 7 is an enlarged schematic sectional view of said embodiment.

The schematic sectional view of the present apparatus is shown in FIGS. 6(*a*) and 6(*b*) and the enlarged schematic sectional view of the inner wall of the vaporizer is shown in FIG. 7.

The present apparatus accumulates tar under the same test conditions as in example (1) as shown and characterized by curve 10 in FIG. 3.

The characteristic curve 10 shows that the quantity of accumulated tar at 1000 hours is about 3.5 milligrams.

What is claimed is:

1. A liquid fuel combustion apparatus, comprising:

a circular vaporizer which includes a burner head, for burning a mixed gas of fuel and air, disposed on a circular metal vessel, said circular metal vessel having an interior defined by at least an inner wall;

an electric sheath heater embedded in said circular metal vessel, for supplying heat to said circular metal vessel in addition to heat feedback by thermal conduction from said burner head to maintain said circular metal vessel at a temperature for boiling a liquid fuel film;

a thermometer attached to said circular metal vessel;

an air inlet and a liquid fuel inlet being in fluid communication with said interior of said circular metal vessel; and means for reducing accumulation of tar which results from boiling a liquid fuel film in said circular metal vessel, said means being a film coated on at least part of said inner wall, said film consisting essentially of 15.0 to 50.0 wt.% high-thermal conductive and high-emissive material, 0.1 to 15.0 wt.% catalyst for decomposing organic materials and 40.0 to 80.0 wt.% binder.

2. An apparatus as in claim 1, wherein said inner wall of said circular metal vessel is completely coated with said film.

3. An apparatus as in claim 1, wherein said liquid fuel inlet causes liquid fuel to impinge against a portion of said inner wall which is not coated by said film and the remainder of the inner wall which is not contacted by said liquid fuel is coated with said film.

4. An apparatus as in claim 1, wherein said inner wall is a roughened inner wall which is coated with said film for reducing accumulation of tar.

5. An apparatus as in claim 1, comprising:

said film consists essentially of 15.0~50.0 wt.% high-thermal conductive and high-emissive material, 0.1~15.0 wt.% catalyst and 40.0~80.0 wt.% binder.

6. An apparatus as in claim 1, comprising:

said high-thermal conductive and high-emissive material is selected from the group consisting of carbon, graphite, beryllium oxide, magnesium oxide, silicon-carbide, vanadium-carbide, tungsten-carbide, titanium-carbide, boron-nitride and zirconium-carbide.

7. An apparatus as in claim 1, comprising:

said catalyst for decomposing organic materials is selected from the group consisting of the oxide of titanium, zirconium, vanadium, chromium, molybdenum, tungsten, manganese, iron, cobalt, nickel, copper, and rare earth metal, the element of platinum and palladium, the inorganic compound of acidic clay, zeolite, calcium silicate, alumina-cement and potassium carbonate.

8. An apparatus as in claim 1, comprising:

a binder is selected from the group consisting of water soluble phosphate, water soluble silicate and silicone resin.

9. An apparatus as in claim 2, comprising:

said film consists essentially of 15.0~50.0 wt.% high-thermal conductive and high-emissive material, 0.1~15.0 wt.% catalyst and 40.0~80.0 wt.% binder.

10. An apparatus as in claim 2, comprising:

said high-thermal conductive and high-emissive material is selected from the group consisting of carbon, graphite, beryllium oxide, magnesium oxide, silicon-carbide, vanadium-carbide, tungsten-carbide, titanium-carbide, boron-nitride and zirconium-carbide.

11. An apparatus as in claim 2, comprising:

a catalyst for decomposing organic materials is selected from the group consisting of the oxide of titanium, zirconium, vanadium, chromium, molybdenum, tungsten, manganese, iron, cobalt, nickel, copper, and rare earth metal, the element of platinum and palladium, the inorganic compound of acidic clay, zeolite, calcium silicate, alumina-cement and potassium carbonate.

12. An apparatus as in claim 2, comprising:

said binder is selected from the group consisting of water soluble phosphate, water soluble silicate and silicone resin.

13. An apparatus as in claim 3, comprising:

said high-thermal conductive and high-emissive material is selected from the group consisting of carbon, graphite, beryllium oxide, magnesium oxide, silicon-carbide, vanadium-carbide, tungsten-carbide, titanium-carbide, boron-nitride and zirconium-carbide.

14. An apparatus as in claim 3, comprising:

said catalyst for decomposing organic materials is selected from the group consisting of the oxide of titanium, zirconium, vanadium, chromium, molybdenum, tungsten, manganese, iron, cobalt, nickel, copper and rare earth metal, the element of platinum and palladium, the inorganic compound of acidic clay, zeolite, calcium silicate, alumina-cement and potassium carbonate.

15. An apparatus as in claim 3, comprising:

said binder is selected from the group consisting of water soluble phosphate, water soluble silicate and silicone resin.

16. An apparatus as in claim 4, comprising:

said high-thermal conductive and high-emissive material is selected from the group consisting of carbon, graphite, beryllium oxide, magnesium oxide, silicon-carbide, vanadium-carbide, tungsten-carbide, titanium-carbide, boron-nitride and zirconium-carbide.

17. An apparatus as in claim 4 comprising:

said catalyst for decomposing organic materials is selected from the group consisting of the oxide of titanium, zirconium, vanadium, chromium, molybdenum, tungsten, manganese, iron, cobalt, nickel, copper and rare earth metal, the element of platinum and palladium, the inorganic compound of acidic clay, zeolite, calcium silicate, alumina-cement and potassium carbonate.

18. An apparatus as in claim 4, comprising:

said binder is selected from the group consisting of water soluble phosphate, water soluble silicate and silicone resin.

* * * * *